United States Patent [19]

Imboden

[11] 4,040,128

[45] Aug. 9, 1977

[54] ONE-PIECE PANTYHOSE CONSTRUCTION

[75] Inventor: Walter H. Imboden, Burlington, N.C.

[73] Assignee: Burlington Industries, Inc., Greensboro, N.C.

[21] Appl. No.: 673,997

[22] Filed: Apr. 5, 1976

[51] Int. Cl.[2] ..... A41B 9/04

[52] U.S. Cl. ..... 2/409

[58] Field of Search ..... 2/409, 408, 240, 406, 2/407, 78 R, 78 A, 78 B, 243 R; 66/177, 178 R, 171

[56] References Cited

U.S. PATENT DOCUMENTS

| | | | |
|---|---|---|---|
| 3,673,821 | 7/1972 | Johnson | 2/409 X |
| 3,696,444 | 10/1972 | Berry | 2/409 |

FOREIGN PATENT DOCUMENTS

| | | | |
|---|---|---|---|
| 1,046,337 | 8/1953 | France | 66/171 |
| 66,108 | 11/1891 | Germany | 66/177 |
| 1,957,656 | 11/1969 | Germany | 66/177 |
| 1,094,103 | 12/1967 | United Kingdom | 66/171 |

*Primary Examiner*—H. Hampton Hunter

*Attorney, Agent, or Firm*—Cushman, Darby & Cushman

[57] ABSTRACT

A one-piece construction for pantyhose or the like that has sufficient crotch rise and contains no excess material in the longitudinal dimension. An integral elongated tube of knit fabric has a waist slit formed in the middle portion thereof extending in the dimension of elongation of the tube. One or more crotch slits are formed in the middle portion of the tube in an area thereof generally opposite the waist slit, the crotch slit(s) extending generally in the dimension of elongation of the tube and each crotch slit having a pair of end terminating points. The end terminating points of the crotch slit(s) are moved toward each other so that the orientation of the crotch slit is changed, the crotch slit assuming a translocated position, and then the tube is closed in the area of the crotch slit while the crotch slit is in the translocated position. Material can be removed from the crotch slit area if the crotch slit area is not of relatively high-stretch material, and the tube closed along a line not including the crotch slit. Also, an insert can be provided in the crotch slit.

25 Claims, 13 Drawing Figures

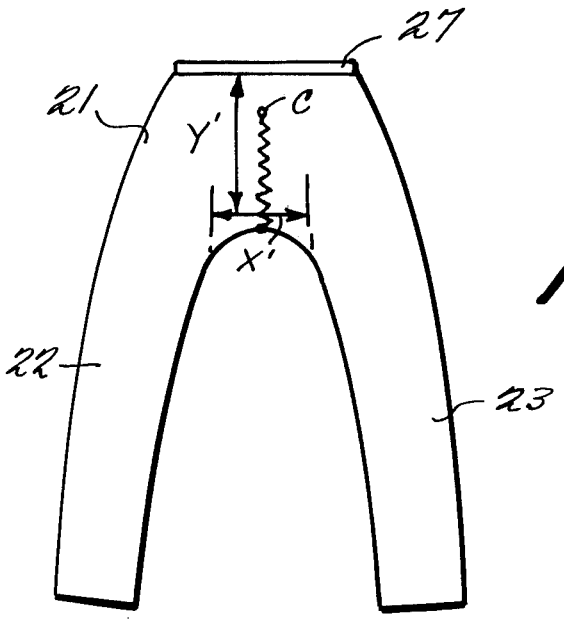
Fig. 2d
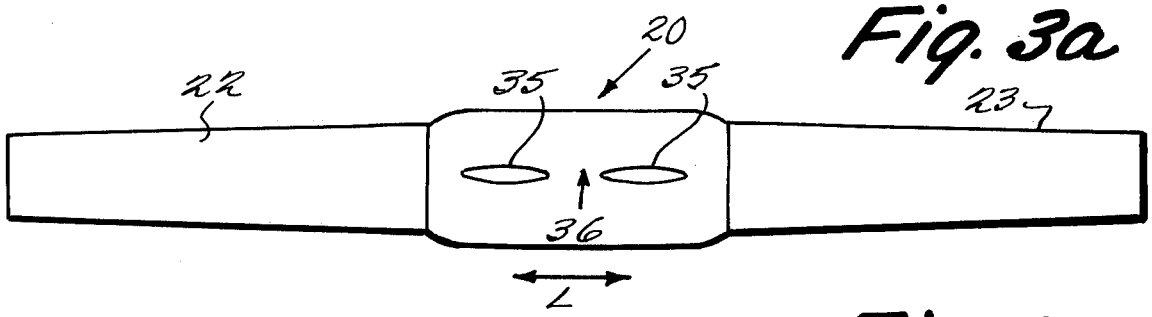
Fig. 3a
Fig. 3b
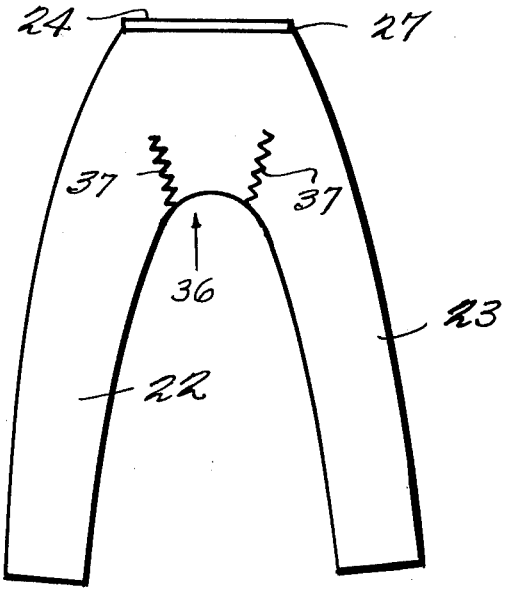
Fig 4
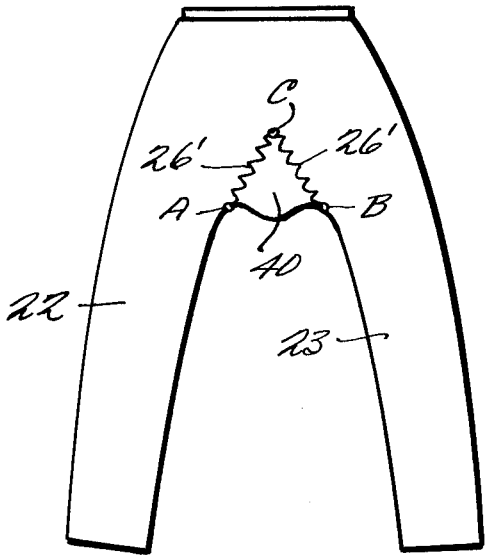

ONE-PIECE PANTYHOSE CONSTRUCTION

BACKGROUND AND SUMMARY OF THE INVENTION

The invention relates to a method of making onepiece pantyhose and the like, and the pantyhose and the like so produced. In the past, there have been several proposals for making pantyhose or the like from a single seamless piece of knit fabric tubing by forming a waist slit in the tubing at a middle portion thereof, and placing a waistband or the like in the waist opening, the legs of the pantyhose or the like being formed by the tube portions on either side of the waistband. Such a proposal is shown in U.S. Pat. No. Re. 27,886. Pantyhose constructed in such a manner has not been generally commercially successful, however, due primarily to the fact that there is excessive crotch fabric in the longitudinal direction (between the legs) which can result in inadequate feel when worn, and there is not enough fabric in the transverse direction, or rather that there is inadequate "crotch rise," resulting in a "bikini," "hipster," or "hip-hugger" effect on many wearers rather than positioning of the waistband at the waist.

According to the teachings of the present invention, pantyhose and the like can be produced from a single seamless piece of knit fabric tubing that does not have the drawbacks of the prior art proposals. According to the pantyhose or the like of the present invention, the excessive longitudinal fabric is converted into greater crotch rise resulting in one-piece pantyhose or the like that fits properly at the waist, with proper feel. This is accomplished by forming one or more crotch slits in the fabric tubing generally extending in the direction of elongation of the tubing at an area thereof generally opposite the waist slit, deforming the slit(s) so that it assumes a different orientation and a translocated position, and then closing the tube in the area of the crotch slit(s) while the crotch slit(s) is in its translocated position so that no slit remains in the tubing area thereof opposite the waist slit. Inserts and the like may be placed in the slits before closing thereof, such as inserts of soft, absorbent material (such as cotton or the like), decorative inserts, or other types of inserts. Also especially where the area of the tubing in which the slit is made is of relatively non-stretch material, material may be removed from the slit area, and the tube closed along a line which at some or all portions may not include the crotch slit.

It is the primary object of the present invention to provide improved one-piece construction pantyhose and the like. This and other objects of the invention will become clear from an inspection of the detailed description of the invention, and from the appended claims.

BRIEF DESCRIPTION OF THE DRAWINGS

FIGS. 2*a*–2*d* show consecutive steps for making pantyhose or the like according to a method of the present invention;

FIGS. 3*a* and 3*b* show consecutive steps for making pantyhose according to a modification of the method of FIGS. 2*a*–2*d;*

FIG. 4 is another modification of pantyhose or the like according to the present invention;

DETAILED DESCRIPTION OF THE INVENTION

Figure 1A:
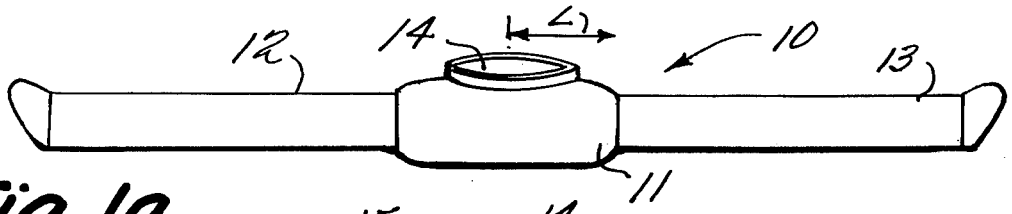
Fig. 1a (PRIOR ART)
FIGS. 1*a* and 1*b* are schematic showings of pantyhose or the like produced according to prior proposals.
Figure 1B:
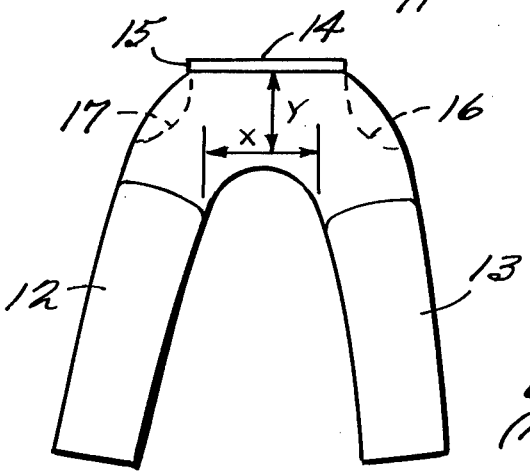
Fig. 1b (PRIOR ART)

According to the prior art proposals for making one-piece construction pantyhose or the like, such as shown in U.S. Pat. No. Re. 27,886, a tube 10 (see FIG. 1*a*) is formed of knit material with at least the area 11 thereof desirably formed of high-stretch material, and the area 11 preferably being of larger diameter than the leg sections 12 and 13 of the tube 10. A waist slit 14 is formed in the tube 10, the slit 14 extending generally in the dimension of elongation L of the tube 10. To form the pantyhose or the like, then a waistband 15 is sewn into the waist slit 14, with the leg sections 12 and 13 extending generally downwardly from the waist slit 14, and pouches 16 or 17 (shown on the dotted line in FIG. 1*b*) may be formed in the area 11. The final product that is produced, as shown in FIG. 1*b,* has relatively little crotch rise (dimension y) and a large amount of excess fabric in the longitudinal dimension (dimension x) resulting in a relatively poor fit.

Figure 2A:
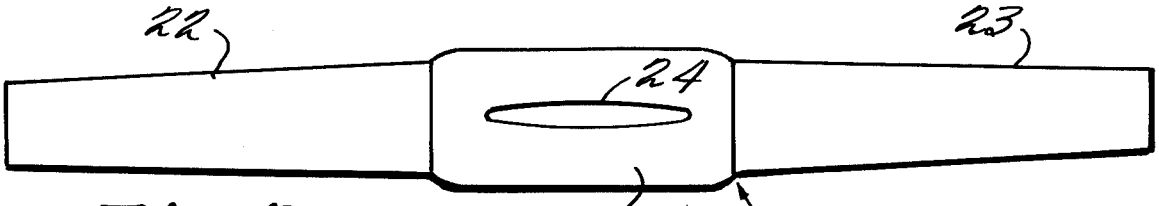
Figure 2B:
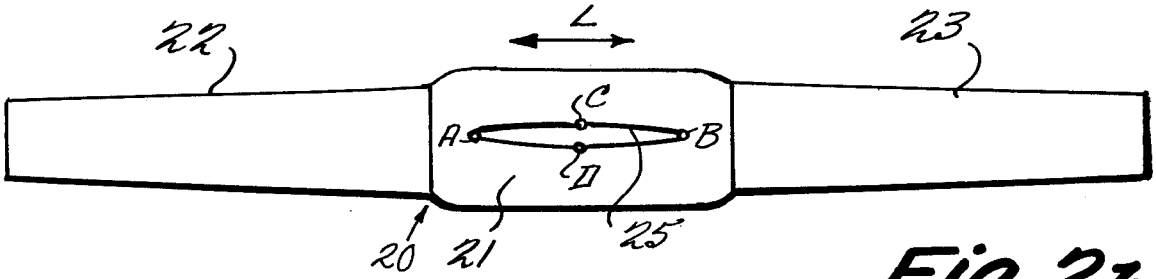
Figure 2C:
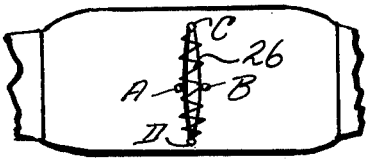

According to the present invention, a tube 20, essentially the same as the tube 10 according to the prior art, is provided, formed of knit fabric. Relative to the description of FIGS. 2–5 preferably, but not necessarily, at least the portion 21 thereof being of high-stretch fabric. The portion 21 may be made of heavier weight material, for example, 40 denier or higher, as indicated in FIG. 2*a,* or of the same weight material, as the leg sections 22 and 23 to provide a so-called "nude" garment, or a garment wherein there is no differentiation between leg and panty, such as in garments commonly called opaques. A waist slit 24 is formed in the tube 20, either on or off the knitting machine, which slit 24 extends substantially in the dimension of elongation L of the tube 20. Then formed in the tube 20 in the area thereof generally opposite the slit 24 is a crotch slit 25 (see FIG. 2*b*). FIG. 2*b* shows the tube 20 of FIG. 2*a* rotated approximately 180° about a symmetrical axis therethrough. While the crotch slit 25 extends generally in the dimension of elongation L of the tube 20, it is to be understood that it may be disposed at an angle with respect to the dimension L (in different wales) as long as the ultimate functions of eliminating excess longitudinal crotch material or creating additional crotch rise are accomplished, and the word "generally" in the present specification and claims is intended to indicate this. Also, while normally the slit 25 would be disposed at about 180° from the waist slit 24, it also could be disposed at other angles from the slit 24 just so that it is generally opposite the slit 24 and so the ultimate function of converting excess longitudinal crotch material into additional crotch rise is accomplished, and again the word generally in the present specification and claims is intended to indicate this.

The crotch slit 25, as shown in FIG. 2*b,* has two terminal points thereof, A and B, and two midpoints thereof, C and D, one midpoint being disposed on either side of the slit 25. To convert the excess material in the dimension L into additional crotch rise, according to the present invention, the end points A and B are moved toward each other, while the midpoints C and D of slit 25 may be moved away from each other to dispose the crotch slit in a translocated position (see FIG. 2*c*), the wales and courses in the fabric around the slit being translocated when the slit is translocated. The tube 21 is then closed in the area of the crotch slit 25 so that no slit remains in said tube middle portion 21, such as by sewing edges CBD and CAD of the crotch slit 25 together to form a seam 26, with points A and B joined. A waistband 27 or the like is sewn in waist slit 24 as is conventional in the art. The final product that is produced, as shown in FIG. 2*d*, has a reduced longitudinal dimension *x'*, as compared to the product of FIG. 1*b*, no excessive longitudinal crotch material being provided, and has increased crotch rise *y'*, over the pantyhose shown in FIG. 1*b*. The section 21 is the hip section, with the leg sections 22, 23 extending downwardly therefrom at a proper angle because of the crotch slit operations according to the present invention, and thus the accessory pouches 16, 17, such as in the prior art pantyhose of FIG. 1*b*, may be eliminated without eliminating their function.

As an alternative to the embodiment described with respect to FIGS. 2*a*–2*d*, pantyhose or the like having no excessive material in the longitudinal direction and increased crotch rise, according to the present invention, may be produced by forming a pair of crotch slits 35 in the area of the tube 20 generally opposite waist slit 24, as shown in FIG. 3*a*. It is also understood that the same principles can be applied for more than two crotch slits. A space 36 is provided between the crotch slits 35, and the slits 35 may be in a straight line relationship with respect to each other, both generally extending in the dimension of elongation L of the tube 20. As with the crotch slit 25 of FIG. 2*b*, the slits 35 may be at an angle with respect to the dimension L and/or may be disposed at an angle (or angles) other than 180° with respect to the waist slit 24. In the FIG. 3*a*, 3*b* embodiment, the crotch slits 35 are closed to form seams 37, cutting out fabric as may be necessary for good fabric distribution, and a waistband 27 is provided in waist slit 24.

In either the FIG. 2 of FIG. 3 embodiments, inserts may be provided in the crotch slit(s) if desired in order to achieve a particular desired shape or volume when a given crotch rise is obtained, in order to provide a particular feel for certain body parts, or for decorative effect, etc. This is readily accomplished, as shown in FIG. 4, by sewing an insert 40 into the crotch slit 25 (or 35), the points A,B then being spaced from each other by the insert 40 forming seam 26'. Cotton can also be added in the knitting process to that portion of the fabric 36 comprising the crotch area (FIGS. 3*a* and 3*b*). Of course, other conventional operations could also be performed on the pantyhose or the like produced, such as forming particular heel and toe sections in the legs 22, 23, etc.

Figure 5A:
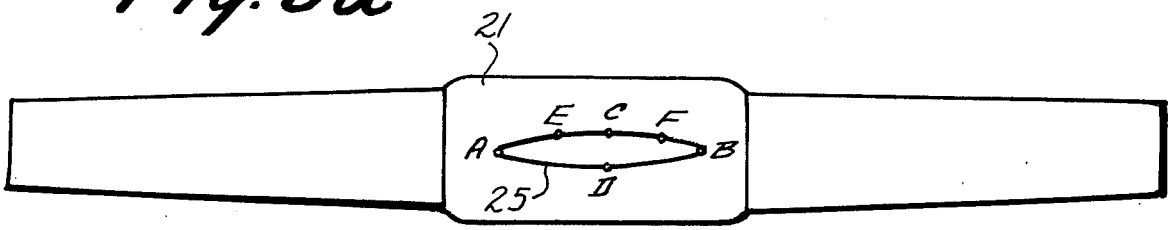
FIGS. 5*a* and 5*b* show consecutive steps for making pantyhose according to another modification of the method of FIGS. 2*a*–2*d.
Figure 5B:
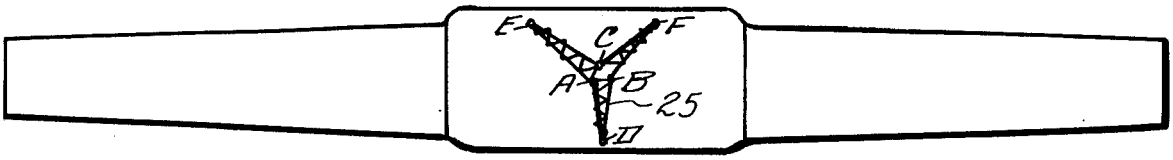

Another modification according to the present invention is shown in FIGS. 5*a* and 5*b*. FIG. 5*a* shows a slit 25 being formed in the middle portion 21 of a tubular pantyhose member or the like as in the other embodiments of the invention, a pair of end points A, B and a pair of midpoints C, D being provided. In addition, a pair of intermediate points E, F are noted for reference purposes. When the slit 25 is reorientated, as shown in FIG. 5*b*, its translocated position is in the form of a Y, lines E, C and F, C forming the upper portions of the Y, and line A, D, B, D forming the base of the Y. When in the Y translocated position, the slit 25 is closed as by sewing, as shown in FIG. 5*b*.

Tuck stiches may be programmed into certain areas of the garment in order to regulate stretch characteristics. In all of the embodiments according to the present invention, during the knitting operation for the tubular member, lines may be formed for the slits 25, 35 (and the waist slit 24 if desired) by knitting with less dense stiches to make a tracing for a slit. Thus, if the slitting and reorientation and resewing are to be done by hand, a marking will be provided for the individual making the slit giving him or her a clear indication of where to cut the slit in the tube.

Figure 6A:
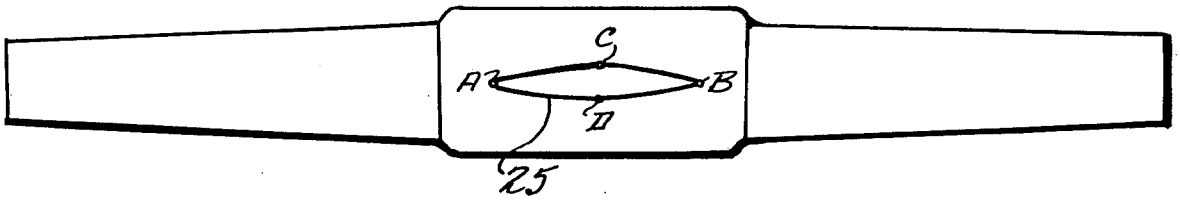
* and FIGS. 6*a* and 6*b* show consecutive steps for making pantyhose according to yet another modification of the method of FIGS. 2*a*–2*d.*
Figure 6B:
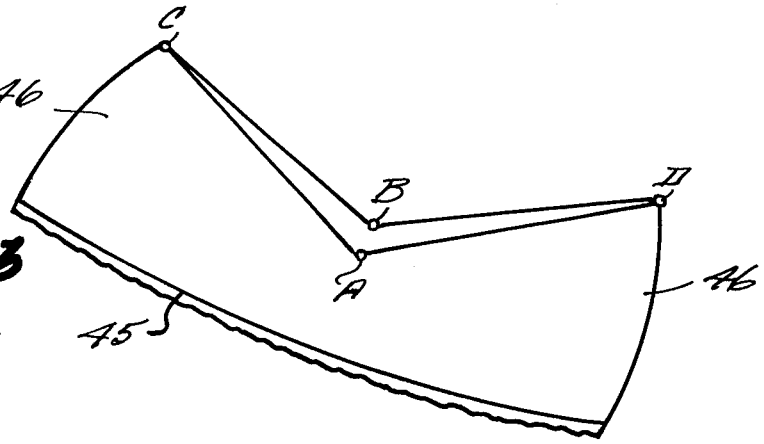

According to the present invention, material in the middle portion 21 of less stretchability than in the prior art pantyhose or the like can be utilized while still obtaining a garment with the required fit. For instance, cotton can be knit into the crotch area 36 of the tube 21 (see FIG. 3*a*). While the methods of FIGS. 2–5 are generally, but not exclusively, for pantyhose or the like wherein the tube 21 is generally of high-stretch material, the method of FIG. 6 is generally, but not exclusively, for pantyhose or the like wherein the tube 21 is of relatively low-stretch material. In such a situation, it may be desirable to remove a greater quantity of the excess material from the crotch area in order to prevent wrinkles or bulging in that area, while increasing the crotch rise of the pantyhose or the like being produced (such wrinkles are less likely in high-stretch material because of better fabric distribution properties thereof). As shown in FIG. 6*a*, a slit 25 is formed in the tubular portion 21 generally opposite the waist slit 24 and again the terminating end points A, B are moved toward each other. During movement of the end points A, B, toward each other, the orientation of the slit 25 is changed, such as to a position shown in FIG. 6*b*, some of the material of the tube portion 21 is cut off, and then the tube is sewn back together so that no slit remains in said tube middle portion generally opposite the waist slit (24). One preferred way of doing this is to sew along the line 45 with an overedge seaming machine (i.e., a Union Special Model 39,500), the seaming machine automatically cutting off the material portion 46 as the seam is made. Of course, cutting can be done with scissors or the like prior to seaming along line 45 instead of using an overedge seaming machine, and the line 45 may have a different curvature or orientation (i.e., it may pass directly through points A, B). Also removal of material in the crotch area could be effected by other means than the formation of a slit and subsequent reorientation and cutting, i.e., by punching out a pattern in the crotch area, as long as reorientation was effected and the end result of more crotch rise was achieved.

While the invention has been herein described primarily with respect to pantyhose, it is to be understood that a wide variety of other lower-body garments could also be produced according to the present invention, such as garments of the class including body stockings, leotards, tights, pantaloons, pants, etc. The term "pantyhose and the like" is intended to encompass all such garments.

While the invention has been herein shown and described in what are presently conceived to be the most practical and preferred embodiments, it will be apparent to those of ordinary skill in the art that many modifications may be made thereof within the scope of the invention, which scope is to be accorded the broadest interpretation of the appended claims so as to encompass all equivalent methods and products.

What is claimed is:

1. A method of making pantyhose or the like comprising the steps of a. forming an integral elongated tube of knit fabric, a waist slit being formed in said tube in the middle portion thereof, said slit extending in the dimension of elongation of said tube, b. forming a crotch slit in the middle portion of said tube in the area thereof generally opposite said waist slit, said crotch slit generally extending in the dimension of elongation of said tube, and said crotch slit having two terminating end points, c. moving said crotch slit terminating end points toward each other so that the orientation of said crotch slit is changed from one generally extending in the dimension of elongation of said tube to one having a different orientation, said crotch slit assuming a translocated position, d. closing said tube in the area of said crotch slit while said crotch slit is in said translocated position, so that no slit remains in said tube middle portion generally opposite said waist slit, and e. providing a waistband or the like in said waist slit.

2. A method as recited in claim 1 comprising the further step of removing material from said crotch slit area before closing said tube while said crotch slit is in said translocated position.

3. A method as recited in claim 2, wherein the material removed from said crotch slit area includes material bordering said crotch slit and wherein said tube is closed along a line in said crotch slit area not including said crotch slit.

4. A method as recited in claim 1 comprising the further step of placing an insert in said crotch slit, and joining both edges defining said crotch slit to said insert while closing said crotch slit in said translocated position.

5. A method as recited in claim 1, comprising the further steps of forming a second crotch slit in the middle portion of said tube in the area thereof generally opposite said waist slit, said second crotch slit extending generally in the dimension of elongation of said tube, said second crotch slit having two terminating end points, moving said second crotch slit terminating end points toward each other so that the orientation of said second crotch slit is changed from one generally extending in the dimension of elongation of said tube to one having a different orientation, said second crotch slit assuming a translocated position, and closing said tube in the area of said second crotch slit while said second crotch slit is in translocated position so that no slit remains in said tube middle portion generally opposite said waist slit.

6. A method as recited in claim 5, comprising the further step of placing an insert in each of said crotch slits, and joining both edges defining each of said crotch slits to said insert while closing said crotch slits in said translocated positions.

7. A method as recited in claim 5, wherein said crotch slit and said second crotch slit are disposed substantially in a straight line relationship when formed in said tube.

8. A method as recited in claim 1, wherein said portion of said tube in which said waist and crotch slits are formed is of greater diameter than the portions of said tube extending on either side thereof, and of heavier construction.

9. A method as recited in claim 1, wherein said crotch slit has a midpoint on either side of said slit and wherein during moving of said crotch slit end terminating points toward each other said midpoints are moved away from each other so that said crotch slit in said translocated position thereof is disposed in a dimension generally transverse to the dimension of elongation of said tube.

10. A method as recited in claim 1, wherein during movement of said crotch slit end points toward each other said slit is disposed generally in the form of a Y in the translocated position thereof, and wherein said slit is closed in said Y position.

11. A method as recited in claim 1, wherein said crotch slit is substantially parallel to said waist slit.

12. A method as recited in claim 1, wherein said crotch slit is formed in the area of said tube substantially 180° from said waist slit.

13. Pantyhose or the like formed from an integral elongated tube of knit fabric, said pantyhose or the like having a waist opening thereof formed in the middle portion thereof, said opening extending in the dimension of elongation of said tube, and a waist band or the like being disposed therein, said pantyhose or the like having a pair of legs extending from said waist opening, and crotch area formed between said legs, crotch area including, a crotch slit in the middle portion of said tube in the area thereof generally opposite said waist slit, said crotch slit generally extending in the dimension of elongation of said tube and having a pair of end terminating points, said crotch slit terminating end points being moved toward each other so that the orientation of said crotch slit is changed from one generally extending in the dimension of elongation of said tube to one having a different orientation, said crotch slit assuming a translocated position, and said tube being closed in the area of said crotch slit while said crotch slit is in said translocated position so that no slit remains in said tube middle portion generally opposite said waist slit, whereby said crotch slit is held in said translocated position after being closed.

14. Pantyhose or the like as recited in claim 13, wherein said crotch area of said pantyhose further includes a second crotch slit formed in the middle portion of said tube in the area thereof generally opposite said waist slit, said second crotch slit generally extending in the dimension of elongation of said tube and having a pair of end terminating points, said second crotch slit end terminating points being moved toward each other so that the orientation of said crotch slit is transformed from one extending generally in dimension of elongation of said tube to one having a different orientation, said second crotch slit assuming a translocated position, and said tube being closed in the area of said second crotch slit while said second crotch slit is in said translocated position so that no slit remains in said tube middle portion generally opposite said waist slit, whereby said crotch slit is held in said translocated position after being closed.

15. Pantyhose or the like as recited in claim 13, wherein said crotch area of said pantyhose or the like further includes an insert placed in said crotch slit and joined to both edges of said tube defining said crotch slit while said crotch slit is closed in said translocated position.

16. Pantyhose or the like as recited in claim 13, wherein said crotch area of said pantyhose or the like has material removed from crotch slit area before said tube is closed in said crotch slit area.

17. Pantyhose or the like as recited in claim 16, wherein the material removed from said crotch slit area includes material bordering said crotch slit and wherein said pantyhose or the like are includes a closure of said tube along a line in said crotch slit area not including said crotch slit.

18. Pantyhose or the like comprising a tubular hip section, having a front, back and two sides, a pair of tubular leg sections extending from said hip section sides, said hip section and leg sections being integral with no seams formed therebetween, a waist opening in the top of said hip section, having a waistband or the like surrounding said opening, and a crotch seam generally extending from a front portion of said hip section to a back portion of said hip section, but not intersecting said waistband or the like, and a leg section being generally disposed on either side of said crotch seam, the fabric in an area surrounding said crotch seam having increased fabric rise, the fabric wales and courses being translocated in said area.

19. Pantyhose or the like as recited in claim 18 further comprising a second crotch seam extending from a front portion of said hip section to a back portion thereof, but not intersecting said waistband or the like, said second crotch seam and said other crotch seam being disposed between said leg sections, and the fabric in an area surrounding said second crotch seam having fabric wales and courses translocated.

20. Pantyhose or the like as recited in claim 19, further comprising an insert in each of said crotch seams.

21. Pantyhose or the like as recited in claim 18, further comprising an insert in said crotch seam.

22. Pantyhose or the like as recited in claim 18 wherein said crotch seam is generally in the form of a Y.

23. A method of making pantyhose or the like comprising the steps of a. forming an integral elongated tube of knit fabric, a waist slit being formed in said tube in the middle portion thereof, said slit extending in the dimension of elongation of said tube, b. forming an opening in the middle portion of said tube in the crotch area thereof, said crotch area being generally opposite said waist slit in said tube middle portion, c. removing material from said crotch area, d. orientating the fabric in the area adjacent said crotch area opening so that the amount of crotch rise in the pantyhose or the like being made is increased, e. closing said opening in said crotch area while said fabric in said crotch area is reorientated so that pantyhose or the like having increased crotch rise is produced, whereby said crotch area opening is held in a reorientated position after being closed, and f. providing a waistband or the like in said waist slit.

24. A method as recited in claim 23 wherein said step of removing material from said crotch area takes place simultaneously with the closing of said opening in said crotch area while said fabric is reorientated.

25. A method as recited in claim 23 wherein said step of removing material from said crotch area is effected before said reorientation and closing steps.

* * * * *